US009574387B2

(12) United States Patent
Jankovsky et al.

(10) Patent No.: US 9,574,387 B2
(45) Date of Patent: Feb. 21, 2017

(54) ALIGNMENT OF OBSTACLE DETECTION COMPONENTS

(71) Applicant: The Chamberlain Group, Inc., Elmhurst, IL (US)

(72) Inventors: Thomas Jason Jankovsky, Elgin, IL (US); Tracy Michelle Tryboski, St. Charles, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 130 days.

(21) Appl. No.: 14/550,324

(22) Filed: Nov. 21, 2014

(65) Prior Publication Data

US 2016/0145926 A1 May 26, 2016

(51) Int. Cl.

| | |
|---|---|
| ***G08B 21/00*** | (2006.01) |
| ***E05F 15/40*** | (2015.01) |
| ***E05F 15/73*** | (2015.01) |
| ***E05F 15/668*** | (2015.01) |
| ***E06B 9/06*** | (2006.01) |
| ***E06B 9/68*** | (2006.01) |
| ***G08B 29/00*** | (2006.01) |
| *E05F 15/77* | (2015.01) |

(52) U.S. Cl.

CPC ..... *E05F 15/40* (2015.01); *E05F 15/668* (2015.01); *E05F 15/73* (2015.01); *E06B 9/0638* (2013.01); *E06B 9/68* (2013.01); *G08B 29/00* (2013.01); *E05F 15/77* (2015.01); *E06B 2009/6836* (2013.01)

(58) Field of Classification Search

CPC ..... E05F 15/40; E05F 15/668; E05F 15/77; E05F 15/73; E06B 7/28

USPC ..... 340/540

See application file for complete search history.

(56) References Cited

U.S. PATENT DOCUMENTS

| | | | | |
|---|---|---|---|---|
| 4,187,494 | A * | 2/1980 | Jessee | B60Q 1/305 280/477 |
| 5,650,764 | A * | 7/1997 | McCullough | B60D 1/36 250/206.1 |
| 6,556,916 | B2 | 4/2003 | Waite | |
| 6,693,557 | B2 | 2/2004 | Arnold | |
| 7,057,519 | B2 * | 6/2006 | Study | G05B 19/0428 318/280 |

(Continued)

OTHER PUBLICATIONS

Skylink Garage Door Opener products and Skylink Universal Access Controls products [online]. Skylink Technologies Inc., Copyright 2013 [retrieved on Jun. 12, 2016]. Retrieved from the Internet: <http://www.skylinkhome.com/>.*

(Continued)

*Primary Examiner* — Nader Bolourchi

(74) *Attorney, Agent, or Firm* — Fitch Even Tabin & Flannery LLP

(57) ABSTRACT

An apparatus having a controller will initiate an obstacle detector alignment mode. An annunciation system of the apparatus effects a first annunciation mode in response to a receiving component of an obstacle detection system receiving a signal transmitted from a transmitting component of the obstacle detection system. The annunciation system effects a second annunciation mode in response to the receiving component of the obstacle detection system not receiving the signal transmitted from the transmitting component of the obstacle detection system.

40 Claims, 6 Drawing Sheets

(56) References Cited

U.S. PATENT DOCUMENTS

| | | | | |
|---|---|---|---|---|
| 7,248,174 | B2 | 7/2007 | Study | |
| 7,379,014 | B1 * | 5/2008 | Woodell | G01S 13/87 342/29 |
| 7,426,450 | B2 | 9/2008 | Arnold | |
| 7,427,930 | B2 | 9/2008 | Arnold | |
| 7,573,400 | B2 | 8/2009 | Arnold | |
| 7,889,097 | B1 | 2/2011 | Arnold | |
| 7,889,098 | B1 | 2/2011 | Arnold | |
| 7,924,170 | B1 | 4/2011 | Arnold | |
| 7,991,542 | B2 | 8/2011 | Giles | |
| 8,379,928 | B2 * | 2/2013 | Kuoch | B60R 21/0134 340/436 |
| 2003/0150164 | A1 * | 8/2003 | Mehalshick | E05F 15/42 49/26 |
| 2008/0142916 | A1 * | 6/2008 | Baldi | G01S 7/032 257/428 |

OTHER PUBLICATIONS

Enforcer—Twin Photobeam Detectors Manual; Seco-Larm USA Inc.; 2010.

http://www.wavetronix.con/uploads/download/file/348/smartsensor_hd_quick-reference_guide-user-20120214144011.en.pdf 2012.

* cited by examiner

ALIGNMENT OF OBSTACLE DETECTION COMPONENTS

TECHNICAL FIELD

The present disclosure generally relates to alignment of obstacle detection components. More specifically, the present disclosure relates to alignment of obstacle detection components for use in movable barrier settings.

BACKGROUND

Movable barrier operators generally serve to selectively move a movable barrier (such as a segmented or one-piece garage door, swinging gate, sliding gate, rolling shutter, and so forth) between an opened and a closed position using one or more motors. It is known to use safe-operation sensors with such operators to aid in ensuring that the movable barrier can be so moved without undue risk to persons or property in the immediate vicinity. Typically, such sensors are designed to detect an obstacle in the path of the moving barrier (particularly when the moving barrier moves to a closed position) through use of light, sound (including ultrasonic sound), radio-frequency, and/or contact sensing mechanisms. In one example, a sensor beam is made to travel across the garage door opening, preferably in a direction generally parallel to the garage floor. Passage of the beam across the garage door opening is continuously monitored.

Upon sensing an obstacle, the sensor provides a corresponding signal, which signal can be used by the movable barrier operator accordingly to aid in avoiding potentially harmful contact between the movable barrier and the detected obstacle. For example, should a sensor detect an obstruction present in the barrier opening, the movable barrier operator may respond by stopping and/or reversing motor energization to stop and/or reverse barrier movement.

Obstacle detection systems often utilize two or more components. For example, a typical obstacle detection system used in a residential garage setting may include a transmitting component placed at one corner of the entryway, and a receiving component placed at the opposite corner of the entryway. Thus, the distance between the two sensor components is approximately the width of the barrier or the barrier opening. A typical residential garage door may range from approximately 9 feet wide to approximately 16 feet wide. In commercial applications, a movable barrier may be approximately 40 feet wide.

In order to function properly, the sensor components must be in alignment. On existing sensor components, a small light-emitting diode (LED) on one or more of the sensor components informs an installer of the alignment status. When the sensor components are not in alignment, the LED will not light up. However, when the installer moves a sensor component into alignment with another sensor component, the LED on one or both of the aligned sensor components lights up. Another method of aligning sensor components of an obstacle detector system includes using a beam of visible light extending from one sensor component to another.

Aligning sensor components of an obstacle detector system can be a tedious, time consuming process. Furthermore, aligning sensor components becomes increasingly difficult as visibility of the LED or beam of light decreases. For example, as the distance between two sensor components increases, it becomes increasingly difficult for the installer to determine whether the LED on the distant component is lit.

Additionally, environmental factors such as direct sunlight or airborne particles may obstruct visibility of a distant LED or beam of light.

SUMMARY

Generally speaking, pursuant to these various embodiments, devices used in movable barrier settings can assist a user with aligning components of an obstacle detection system. While a device is in an alignment mode, the user is provided feedback informing whether the components of the obstacle detection system are in alignment.

These teachings are highly flexible in practice and will accommodate use in combination with a wide variety of sensors and movable barrier operators. It will be appreciated that such an approach can be readily deployed in conjunction with a wide variety of already-deployed movable barrier operator with little or no modification to the legacy equipment. These and other benefits may become clearer upon making a thorough review and study of the following detailed description.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Figure 1:
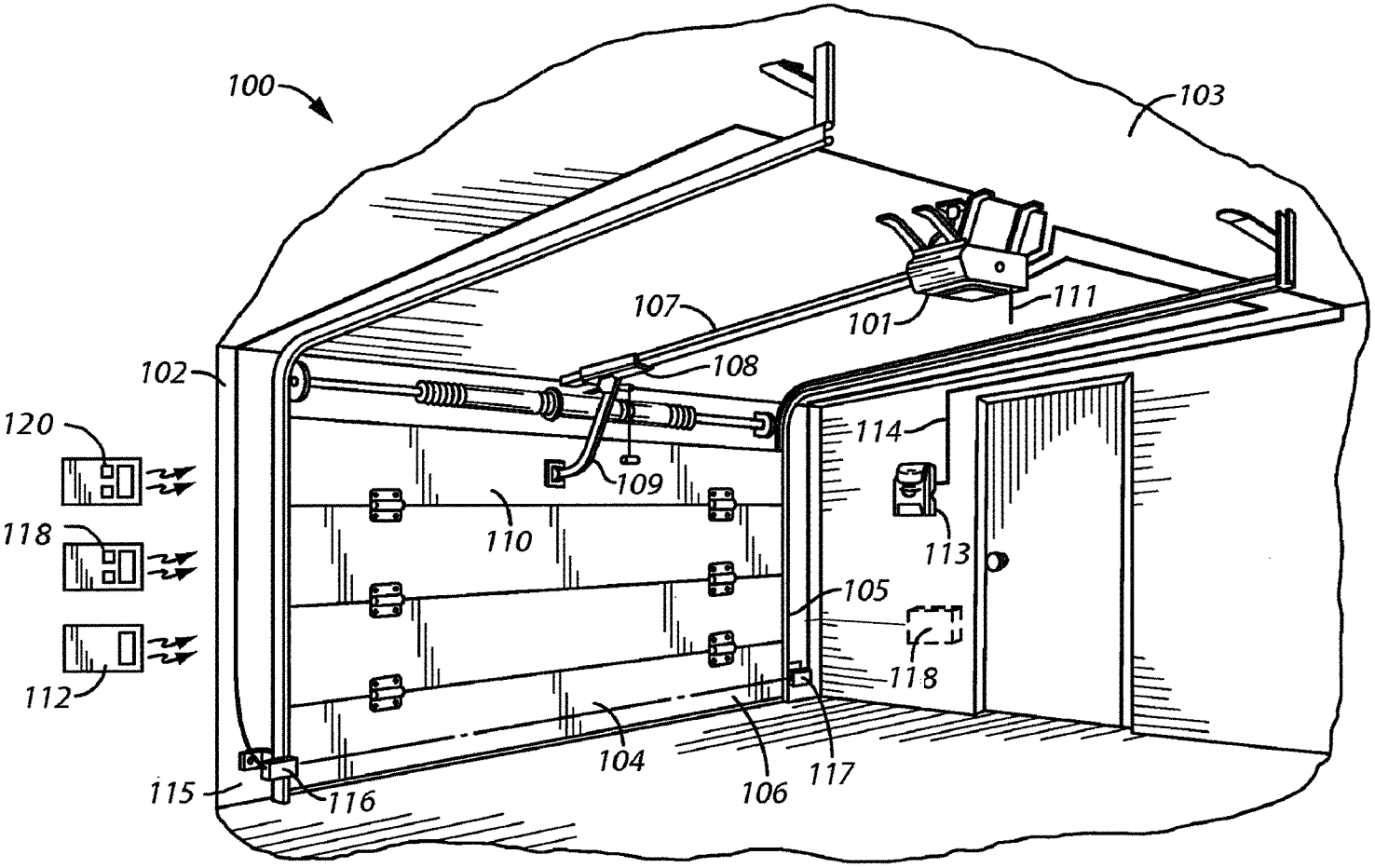
FIG. 1 comprises a barrier movement system connected to a garage door.

Referring now to the drawings, and in particular to FIG. 1, it may be helpful to first describe an illustrative application setting. It will be understood that the specifics of this example are intended to serve only in an illustrative regard and are not intended to express or suggest any corresponding limitations with respect to the scope of these teachings. In this illustrative example, a movable barrier system 100 comprises, in part, a movable barrier operator 101 positioned within a garage 102. This movable barrier operator mounts to the garage ceiling 103 and serves to control and effect selective movement of a multipanel garage door 104. The multipanel garage door includes a plurality of rollers (not shown) rotatably confined within a pair of tracks 105 positioned adjacent to and on opposite sides of the garage opening 106.

The movable barrier operator 101 includes a head unit having a motor (not shown) to provide motion to the garage door 104 via a rail assembly 107. The rail assembly includes a trolley 108 for releasable connection of the head unit to the garage door 104 via an arm 109. The arm connects to an upper portion 110 of the garage door 104. The trolley 108 connects to an endless chain (or belt or the like) (not shown) that effects the desired movement of the trolley 108 and hence the door 104 via the arm 109. This chain can be driven by a sprocket (not shown) that couples to the aforementioned motor in the head unit.

The head unit may also include a radio frequency receiver (not shown) having an antenna 111 to facilitate sending transmissions to and receiving transmissions from one or more radio transmitters 112. These transmitters 112 may include personally-portable transmitters (such as keyfob-style transmitters) or mobile-installed keypad transmitters (such as those often installed in automobile sun visors or headliners) as well as remotely-located non-mobile keypad transmitters (as are sometimes mounted on a wall within, for example, a garage or outside the garage on a nearby wall or framing member). The radio receiver typically connects to a processor (not shown) in the head unit that interprets received signals and responsively controls other portions of the garage door operator 101.

A wall control unit 113 communicates over a line 114 with the head unit to effect control of a garage door operator motor and other components (such as a light (not shown)). The entire head unit is typically powered from a power supply (not shown).

Figure 2:
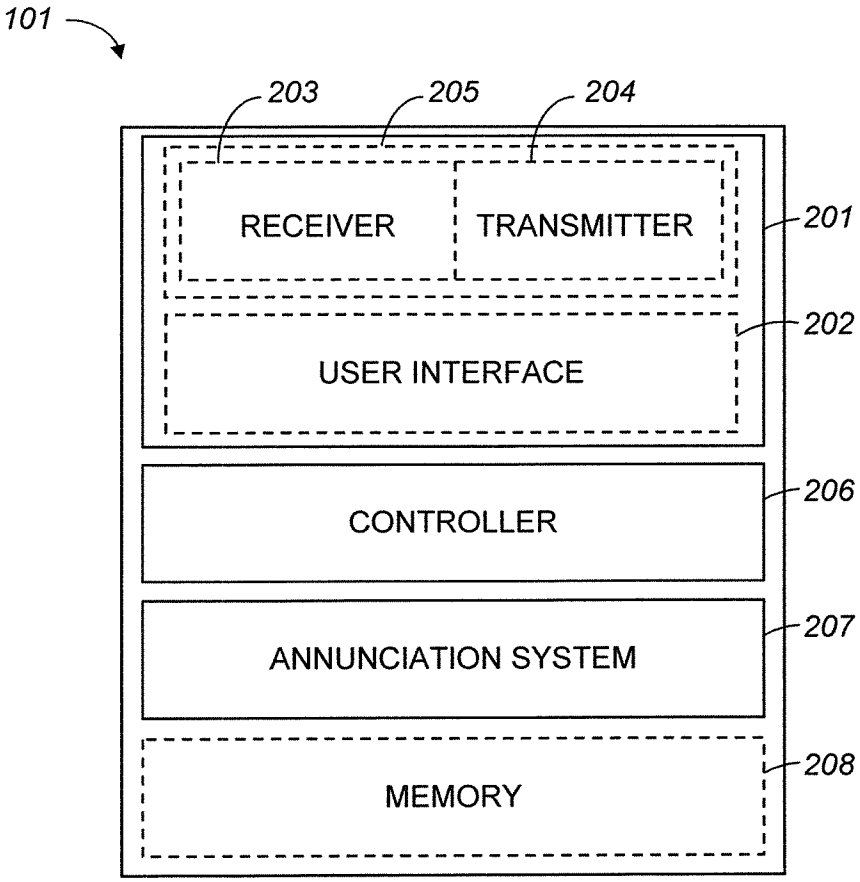
FIG. 2 comprises a schematic block diagram of a movable barrier operator as configured in accordance with an embodiment of the invention.

In a first embodiment, as illustrated in FIG. 2, the movable barrier operator 101 includes an interface 201. Through the interface 201, the movable barrier operator 101 can communicate with a user and/or other devices. The interface 201 is configured to receive an input. In one aspect, the input is received in the form of user input at a user interface 202 of the movable barrier operator 101. The user interface 202 may include, for example, buttons, switches, or a touch screen for receiving an input from a user.

The interface 201 also may include one or more receivers 203 for receiving communications from other devices. For example, the movable barrier operator 101 may receive via the interface 201 transmissions from a wireless operator control device, such as a remote transmitter 112, or from a wired operator control device, such as a wall-mounted unit 113. These operator control devices permit a user to effect control of a movable barrier operator 101 and, optionally, other components of the movable barrier system 100 (such as a motor or light (not shown)). The movable barrier operator 101 may also receive transmissions from other devices, such as components of an obstacle detection system 115 (discussed in greater detail below) and other remote communication devices 120 capable of communicating with the movable barrier operator. Examples of other remote communication devices 120 include personal computers, portable computers, tablets, and smartphones. The receiver 203 may also receive transmissions from one or more web servers. Thus, through the receiver 203, the movable barrier operator 101 is capable of receiving communications from any internet-enabled device via a web server.

Communications received by the movable barrier operator 101 may include commands (such as "open" or "close" a barrier, or "initiate" or "terminate" an obstacle detector alignment mode), or may include status information (such as "obstacle detection system active," "obstacle detector alignment mode initiated," or "light on").

In an optional approach, the interface 201 is configured to provide an output. In one aspect, the output provides feedback to a user. For example, the user interface 202 may include a liquid crystal display, light emitting diode, or other display to provide information to a user. This information may pertain to the movable barrier operator 101 or to any of the other components of the movable barrier system 100 discussed herein. The user interface 201 may also include a feedback indicator to inform a user of an obstacle detector alignment status.

In another optional approach, the interface 201 may include one or more transmitters 204 for transmitting communications to other devices. Communications transmitted by the movable barrier operator 101 may include commands (such as "turn on" or "enter alignment mode"), or may include status information (such as "obstacle detector system aligned"). The transmitter 204 may be a separate component from the receiver 203, or may be integrated as a single transceiver 205 such that communications with other devices are transmitted by and received at the transceiver 205.

Communications between the movable barrier operator 101 and other devices may be wired or wireless. Wired communications may via electrical transmission cables, coaxial cables, Ethernet cables, fiber optic communication cables, or other communication cables. Wireless communications may be in the form of any wireless communication technology, including cellular communications (such as cellular data networks, text, and short message services), radio waves and other radio communications, wireless local area networks (such as Wi-Fi or WiMax networks), personal area networks (such as a Bluetooth, IrDA, or ZigBee), and other internet communications. Additional forms of known wired and wireless communication may also be utilized.

In the illustrative example shown in FIG. 1, the movable barrier system 100 includes an obstacle detection system 115 in communication with the movable barrier operator 101. Obstacle detection system 115 includes a first component 116 in communication with a second component 117 such that the obstacle detection system 115 detects when an obstacle is in the path of the garage door 104. Depending upon operational needs and/or the anticipated application, a wide variety of obstacle detection systems can be supported in this fashion, including optically-based obstacle detectors, pressure-sensitive obstacle detectors, sonically-based obstacle detectors, and radio-frequency based obstacle detectors. The first component 116 may be, for example, an infrared source, and the second component 117 may be an infrared detector, receiver, or reflector. These embodiments will also support the use of a plurality of obstacle detection systems 115 if so desired.

Upon detection of an obstacle, the obstacle detection system 115 signals the movable barrier operator 101 which can then, for example, cause a reversal or opening of the door 104 to avoid contact with the obstacle.

The obstacle detection system 115 may also include a third component, such an obstacle detection system control unit 118. The obstacle detection system control unit 118 may be, for example, a control unit for controlling operation of the obstacle detection system 115. In this regard, the control unit may control a power state or an alignment mode state (discussed in greater detail below) of the obstacle detection system 115. The control unit may be incorporated in or hard wired to one or both of the first and second components 116, 117 of the obstacle detection system 115, or may be in wireless communication with one or both of the first and second components 116, 117.

To align the components of an obstacle detector system 115, a user, either by hand or through a control device (e.g., obstacle detection system control unit 118), adjusts the position and/or the orientation of one or more components until they are aligned. As used herein, "align" and "alignment" refer to whether the components of the obstacle detection system are positioned such that the obstacle detection system is capable of detecting an obstruction. For example, obstacle detection systems using two or more photoelectric (or photo eye) sensors typically require a receiving component to be positioned such that it can receive light (e.g., infrared or amplified light) transmitted by a transmitting component. The two components are "aligned" when the receiving component is positioned such that it can receive the light transmitted by the transmitting component. In another approach, a single combined emitter/receiver can emit the light to a reflective surface, which reflects the light back to the combined emitter/receiver for detection.

Turning back to FIG. 2, the movable barrier operator 101 includes a controller 206 configured to open or initiate an obstacle detector alignment mode. The obstacle detector alignment mode is a temporal operating state of the movable barrier operator 101. Initiation of the obstacle detector alignment changes the operating state of the movable barrier operator 101 from one state to another; for example, from "obstacle detector alignment mode OFF" to "obstacle detector alignment mode ON." The temporal nature of the alignment mode also allows the movable barrier operator 101 to provide ephemeral alignment feedback (discussed in greater detail below) that would be a distraction or annoyance if constant.

In one approach, the controller 206 initiates the obstacle detector alignment mode in response to detecting an obstacle detection system 115. For example, the movable barrier operator 101 may automatically detect an initial installation of one or more components of the obstacle detection system 115. Alternatively, the movable barrier operator 101 may determine one or more components of the obstacle detection system 115 are not aligned. For example, in the event a previously aligned component of the obstacle detection system 115 is knocked out of alignment with respect to another component, the movable barrier operator 101 determines the components of the obstacle detection system 115 are not aligned and initiates the obstacle detector alignment mode. The determination of misalignment may be the result of receiving an affirmative indication of misalignment from the obstacle detection system 115, or may instead be the result of not receiving an alignment indication from the obstacle detection system 115.

In another approach, the controller 206 initiates the obstacle detector alignment mode in response to receiving an input at the interface 201 of the movable barrier operator 101. In one example, the input is a user input received at the user interface 202 of the movable barrier operator 101. In this regard, a user may instruct the movable barrier operator 101 to initiate the obstacle detector alignment mode by pressing a button at the user interface 202 of the movable barrier operator 101. In another example, the input is received at the receiver 203 from another device, such as from a wireless operator control device (e.g., remote transmitter 112), from a wired operator control device (e.g., wall-mounted unit 113), from one or more components of obstacle detection system 115, or from a remote communication device 120 (e.g., a personal computer, a portable computer, a tablet, or a smartphone). The input received from one of these other devices may be the result of a user input at the other device, or may be the result of misalignment determination by the other device.

Based on input received at the interface 201, the movable barrier operator 101 is informed, or itself determines, whether the components of the obstacle detection system 115 are aligned. In a first approach, one or more components of the obstacle detection system 115 send the movable barrier operator 101 information relating to the alignment status of the obstacle detection system 115. Other devices of the movable barrier system 100 may also provide information relating to the alignment status of the obstacle detection system 115 to the movable barrier operator 101. The information relating to the alignment status of the obstacle detection system 115 may include an affirmative indication of alignment or an affirmative indication of misalignment.

In a second approach, the movable barrier operator 101 is informed whether the components of the obstacle detection system 115 are aligned based on the absence of information received at the interface 201. In a first example of this approach, the movable barrier operator 101 is configured to receive an affirmative indication of alignment. Here, the movable barrier operator 101 is informed of misalignment when it does not receive the affirmative indication of alignment. In a second example of this approach, the movable barrier operator 101 is configured to receive an affirmative indication of misalignment. Here, the movable barrier operator 101 is informed of alignment when it does not receive the affirmative indication of misalignment.

As shown in FIG. 2, the movable barrier operator 101 includes an annunciation system 207. The annunciation system 207 may include one or more speakers, lights, or display screens, or any combination thereof, to provide a user visual and/or audible feedback. Preferably, the visual and/or audio feedback is of a volume or intensity sufficient to alert a user located away (such as 15 feet or more) from the movable barrier operator 101. Audible feedback may be preferable in a brightly lit setting in which a light on the movable barrier operator 101 may be difficult to see at a distance. Visual feedback may be preferable in a loud setting in which a sound emitted from a speaker on the movable barrier operator 101 may be difficult to hear at a distance. In some settings, a combination of audio and visual feedback is preferable.

As previously discussed, a user must adjust the position and/or orientation of one or more components of the obstacle detection system 115 until the components are aligned. The annunciation system 207 described herein assists a user with aligning components of an obstacle detection system 115 by providing one form of feedback when the components are aligned, and a second form of feedback when the components are not aligned. In this regard, the annunciation system 207 of the movable barrier operator 101 is configured to effect a first annunciation mode in response to a receiving component of the obstacle detection system 115 receiving a signal transmitted from a transmitting component of the obstacle detection system 115, and a second annunciation mode in response to the receiving component of the obstacle detection system 115 not receiving the signal transmitted from the transmitting component of the obstacle detection system 115.

In one approach, the annunciation system 207 is configured to emit a first audible signal in the first annunciation mode, and emit a second audible signal in the second annunciation mode. For example, the annunciation system may emit a constant sound effect in response to the receiving component receiving the signal transmitted from the transmitting component, and may emit a varying sound effect (e.g., beeps) in response to the receiving component not receiving the signal transmitted from the transmitting component, or vice versa.

In another approach, the annunciation system 207 is configured to emit an audible signal in the first annunciation mode, and emit no audible signal in the second annunciation mode. For example, the annunciation system 207 may emit a constant or varying sound effect in response to the receiving component receiving the signal transmitted from the transmitting component, and may emit no sound effect in response to the receiving component not receiving the signal transmitted from the transmitting component.

In yet another approach, the annunciation system 207 is configured to emit no audible signal in the first annunciation mode, and emit an audible signal in the second annunciation mode. For example, the annunciation system 207 may emit no sound effect in response to the receiving component receiving the signal transmitted from the transmitting component, and may emit a constant or varying sound effect in response to the receiving component not receiving the signal transmitted from the transmitting component.

In yet another approach, the annunciation system 207 is configured to emit a first optical signal in the first annunciation mode, and emit a second optical signal in the second annunciation mode. For example, the annunciation system 207 may emit a constant light in response to the receiving component receiving the signal transmitted from the transmitting component, and may emit a varying light (e.g., flashes) in response to the receiving component not receiving the signal transmitted from the transmitting component, or vice versa.

In yet another approach, the annunciation system 207 is configured to emit an optical signal in the first annunciation mode, and no optical signal in the second annunciation mode. For example, the annunciation system 207 may emit a constant or varying light in response to the receiving component receiving the signal transmitted from the transmitting component, and may emit no light in response to the receiving component not receiving the signal transmitted from the transmitting component.

In yet another approach, the annunciation system 207 is configured to emit no optical signal in the first annunciation mode, and emit an optical signal in the second annunciation mode. For example, the annunciation system 207 may emit no light in response to the receiving component receiving the signal transmitted from the transmitting component, and may emit a constant or varying light in response to the receiving component not receiving the signal transmitted from the transmitting component.

The feedback provided in the first and second annunciation modes is not intended to be limited to the above-described examples. Various combinations audio and visual feedback are envisioned. For example, the annunciation system 207 may emit a light in response to the receiving component receiving the signal transmitted from the transmitting component, and may emit sound in response to the receiving component not receiving the signal transmitted from the transmitting component. Furthermore, variations in the feedback are envisioned. For example, a light intensity in the first annunciation mode may vary from a light intensity in the second annunciation mode; a sound volume in the first annunciation mode may vary from a sound volume in the second annunciation mode; a beeping frequency in the first annunciation mode may vary from a beeping frequency in the second annunciation mode, etc.

In an optional approach, the annunciation system 207 of the movable barrier operator 101 is configured to effect a third annunciation mode in response to the receiving component of the obstacle detection system 115 receiving a signal transmitted from the transmitting component of the obstacle detection system that is less than a predetermined threshold. This may occur, for example, when the receiving and transmitting components are only partially aligned, and the receiving component receives a portion of, but less than the full signal transmitted from the transmitting component. In this approach, the annunciation system 207 is configured to emit a signal that is different than the signals emitted (or not emitted) in the first and second annunciation modes. The signal emitted in the third annunciation mode may be of the same type of signal emitted in the first and/or second annunciation modes, but may differ, for example, in volume, intensity, frequency, or the like.

An illustrative example of use will now be described. When the movable barrier operator 101 is in the obstacle detector alignment mode, and when the receiving component of the obstacle detection system 115 does not receive a signal transmitted from the transmitting component of the obstacle detection system 115, the annunciation system 207 effects the second annunciation mode (for example, a slow beeping sound). As the user moves one of the components into partial alignment with the other component, the annunciation system 207 optionally effects the third annunciation mode (for example, a faster beeping sound). Once the user moves one of the components into full alignment with the other component, the annunciation system 207 effects the first annunciation mode (for example, a constant sound). In this way, the annunciation system 207 assists the user during alignment of the components of the obstacle detection system 115.

The controller 206 of the movable barrier operator 101 is further configured to close or terminate the obstacle detector alignment mode. In one approach, the controller 206 closes the obstacle detector alignment mode after a defined period of time, preferably in the range of one second to three hundred seconds. For example, the controller 206 may close the obstacle detector alignment mode after sixty seconds.

In another approach, the controller 206 closes the obstacle detector alignment mode after the first annunciation mode has been effected for a defined period of time, preferably in the range of one second to sixty seconds. For example, the controller 206 may close the obstacle detector alignment mode after the first annunciation mode has been effected for five seconds.

In another approach, the controller 206 is configured to close or terminate the obstacle detector alignment mode in response to receiving an input at the interface 201 of the movable barrier operator 101. In one example, the input is a user input received at the user interface 202 of the movable barrier operator 101. In this regard, a user may instruct the movable barrier operator 101 to close the obstacle detector alignment mode by pressing a button at the user interface 202 of the movable barrier operator 101. In another example, the user input is received at the receiver 203 from another device, such as from a wireless operator control device (e.g., remote transmitter 112), from a wired operator control device (e.g., wall-mounted unit 113), from one or more components of obstacle detection system 115, or from a remote communication device 120 (e.g., a personal computer, a portable computer, a tablet, or a smartphone). The input received from one of these other devices may be the result of a user input at the other device, or may be the result of alignment detection by the other device.

In the event that the obstacle detector alignment mode is closed prior to alignment of the components, the annunciation system 207 may be configured to cease effecting the second annunciation mode.

The movable barrier operator 101 may further include a memory 208. The memory 208 may store information pertaining to the movable barrier operator 101 including, for example, operational instructions and obstacle status information. The memory 208 may also store information pertaining to various components of the movable barrier system 100 including, for example, a remote transmitter 112, a wall control unit 113, the obstacle detection system 115, or a remote communication device 120 (e.g., a personal computer, a portable computer, a tablet, or a smartphone). Stored information may include component identification information, operational information, and status information.

The above embodiment describes a first embodiment in which a movable barrier operator is capable of assisting a user with aligning components of an obstacle detection system. Additional embodiments for assisting a user with aligning components of an obstacle detection system are discussed below.

Figure 3:
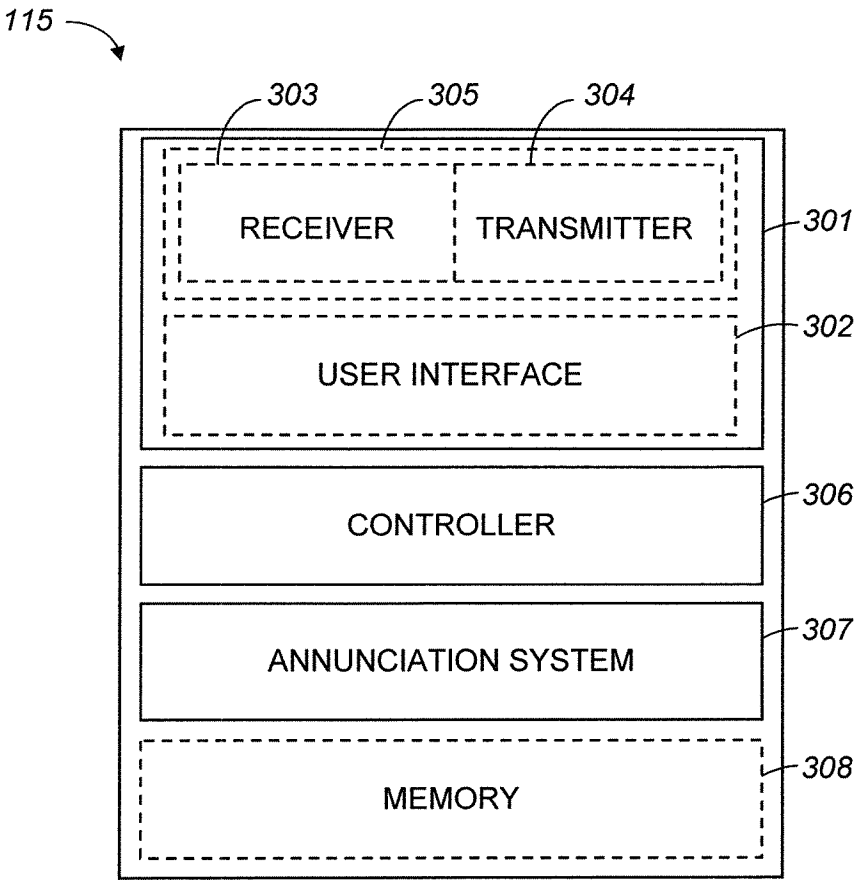
FIG. 3 comprises a schematic block diagram of a component of an obstacle detection system as configured in accordance with an embodiment of the invention.

In a second embodiment, as illustrated in FIG. 3, one or more components of the obstacle detection system 115 are capable of assisting a user with aligning components of the obstacle detection system 115. The one or more components may be the receiving component of the obstacle detection system 115, the transmitting component of the obstacle detection system 115, or another component of the obstacle detection system 115 (e.g., 118 in FIG. 1).

In this embodiment, the component of the obstacle detection system 115 includes an interface 301. Through the interface 301, the component of the obstacle detection system 115 can communicate with a user and/or other devices.

The interface 301 is configured to receive an input. In one aspect, the input is received in the form of user input at a user interface 302 of the component of the obstacle detection system 115. The user interface 302 may include, for example, buttons, switches, or a touch screen for receiving an input from a user.

The interface 301 also may include one or more receivers 303 for receiving communications from other devices. For example, the component of the obstacle detection system 115 may receive via the interface 301 transmissions from a wireless operator control device, such as a remote transmitter 112, or from a wired operator control device, such as a wall-mounted unit 113. The component of the obstacle detection system 115 may also receive transmissions from other devices, such as the movable barrier operator 101 and other remote communication devices 120 capable of communicating with the movable barrier operator. Examples of other remote communication devices 120 include personal computers, portable computers, tablets, and smartphones.

The receiver 303 may also receive transmissions from one or more web servers. Thus, through the receiver 303, the component of the obstacle detection system 115 is capable of receiving communications from any internet-enabled device via a web server.

Communications received by the component of the obstacle detection system 115 may include commands (such as "initiate" or "terminate" an obstacle detector alignment mode), or may include status information (such as "obstacle detection system active," "obstacle detector alignment mode initiated," or "light on").

In an optional approach, the interface 201 is configured to provide an output. In one aspect, the output provides feedback to a user. For example, the user interface 202 may include a liquid crystal display, light emitting diode, or other display to provide information to a user. This information may pertain to the obstacle detection system 115 or to any of the other components of the movable barrier system 100 discussed herein. The user interface 201 may also include a feedback indicator to inform a user of an obstacle detector alignment status.

In another optional approach, the interface 301 may include one or more transmitters 204 for transmitting communications to other devices. Communications transmitted by the component of the obstacle detection system 115 may include commands (such as "turn on" or "enter alignment mode"), or may include status information (such as "obstacle detector system aligned"). The transmitter 304 may be a separate component from the receiver 303, or may be integrated as a single transceiver 305 such that communications with other devices are transmitted by and received at the transceiver 305.

Communications between the component of the obstacle detection system 115 and other devices may be wired or wireless and may be communicated via any of the methods and means discussed herein.

The component of the obstacle detection system 115 includes a controller 206 configured to open or initiate an obstacle detector alignment mode. The obstacle detector alignment mode is a temporal operating state of the component of the obstacle detection system 115. Initiation of the obstacle detector alignment changes the operating state of the component of the obstacle detection system 115 from one state to another; for example, from "obstacle detector alignment mode OFF" to "obstacle detector alignment mode ON." The temporal nature of the alignment mode also allows the component of the obstacle detection system 115 to provide ephemeral alignment feedback that would be a distraction or annoyance if constant.

In one approach, the controller 306 initiates the obstacle detector alignment mode in response to detecting an obstacle detection system 115. For example, the obstacle detection system 115 may automatically detect an initial installation of one or more components of the obstacle detection system 115. Alternatively, the component of the obstacle detection system 115 may determine one or more components of the obstacle detection system 115 are not aligned. For example, in the event a previously aligned component of the obstacle detection system 115 is knocked out of alignment with respect to another component, the component of the obstacle detection system 115 determines the components of the obstacle detection system 115 are not aligned and initiates the obstacle detector alignment mode. The determination of misalignment may be the result of receiving an affirmative indication of misalignment, or may instead be the result of not receiving an alignment indication.

In another approach, the controller 306 initiates the obstacle detector alignment mode in response to receiving an input at the interface 301 of the component of the obstacle detection system 115. In one example, the input is a user input received at the user interface 302 of the component of the obstacle detection system 115. In this regard, a user may instruct the component of the obstacle detection system 115 to initiate the obstacle detector alignment mode by pressing a button at the user interface 302 of the component of the obstacle detection system 115. In another example, the input is received at the receiver 303 from another device, such as from the movable barrier operator 101, from a wireless operator control device (e.g., remote transmitter 112), from a wired operator control device (e.g., wall-mounted unit 113), from another component of the obstacle detection system 115, or from a remote communication device 120 (e.g., a personal computer, a portable computer, a tablet, or a smartphone). The input received from one of these other devices may be the result of a user input at the other device, or may be the result of misalignment determination by the other device.

Based on input received at the interface 301, the component of the obstacle detection system 115 is informed, or itself determines, whether the components of the obstacle detection system 115 are aligned. In a first approach, other components of the obstacle detection system 115 send the component of the obstacle detection system 115 information relating to the alignment status of the obstacle detection system 115. Other devices of the movable barrier system 100 may also provide information relating to the alignment status of the obstacle detection system to the component of the obstacle detection system 115. The information relating to the alignment status of the obstacle detection system 115 may include an affirmative indication of alignment or an affirmative indication of misalignment.

In a second approach, the component of the obstacle detection system 115 is informed whether the components of the obstacle detection system 115 are aligned based on the absence of information received at the interface 301. In a first example of this approach, the component of the obstacle detection system 115 is configured to receive an affirmative indication of alignment. Here, the component of the obstacle detection system 115 is informed of misalignment when it does not receive the affirmative indication of alignment. In a second example of this approach, the component of the obstacle detection system 115 is configured to receive an affirmative indication of misalignment. Here, the component of the obstacle detection system 115 is informed of alignment when it does not receive the affirmative indication of misalignment.

As shown in FIG. 3, the component of the obstacle detection system 115 includes an annunciation system 307. The annunciation system 307 may include one or more speakers, lights, or display screens, or any combination thereof, to provide a user visual and/or audible feedback. Preferably, the visual and/or audio feedback is of a volume or intensity sufficient to alert a user located away (such as 15 feet or more) from the component of the obstacle detection system 115. Audible feedback may be preferable in a brightly lit setting in which a light on the component of the obstacle detection system 115 may be difficult to see at a distance. Visual feedback may be preferable in a loud setting in which a sound emitted from a speaker on the component of the obstacle detection system 115 may be difficult to hear at a distance. In some settings, a combination of audio and visual feedback is preferable.

As previously discussed, a user must adjust the position and/or orientation of one or more components of the obstacle detection system 115 until the components are aligned. The annunciation system 307 described herein assists a user with aligning components of an obstacle detection system 115 by providing one form of feedback when the components are aligned, and a second form of feedback when the components are not aligned. In this regard, the annunciation system 307 of the component of the obstacle detection system 115 is configured to effect a first annunciation mode in response to a receiving component of the obstacle detection system 115 receiving a signal transmitted from a transmitting component of the obstacle detection system 115, and a second annunciation mode in response to the receiving component of the obstacle detection system 115 not receiving the signal transmitted from the transmitting component of the obstacle detection system 115.

The various annunciation modes, and combinations thereof, discussed above with respect to the movable barrier operator are similarly utilized by the annunciation system 307 of the component of the obstacle detection system 115.

In an optional approach, the annunciation system 307 of the component of the obstacle detection system 115 is configured to effect a third annunciation mode in response to the receiving component of the obstacle detection system 115 receiving a signal transmitted from the transmitting component of the obstacle detection system that is less than a predetermined threshold. This may occur, for example, when the receiving and transmitting components are only partially aligned, and the receiving component receives a portion of, but less than the full signal transmitted from the transmitting component. In this approach, the annunciation system 307 is configured to emit a signal that is different than the signals emitted (or not emitted) in the first and second annunciation modes. The signal emitted in the third annunciation mode may be of the same type of signal emitted in the first and/or second annunciation modes, but may differ, for example, in volume, intensity, frequency, etc.

An illustrative example of use will now be described. When the component of the obstacle detection system 115 is in the obstacle detector alignment mode, and when the receiving component of the obstacle detection system 115 does not receive a signal transmitted from the transmitting component of the obstacle detection system 115, the annunciation system 307 effects the second annunciation mode (for example, a slow beeping sound). As the user moves one of the components into partial alignment with the other component, the annunciation system 307 optionally effects the third annunciation mode (for example, a faster beeping sound). Once the user moves one of the components into full alignment with the other component, the annunciation system 307 effects the first annunciation mode (for example, a constant sound). In this way, the annunciation system 307 assists the user during alignment of the components of the obstacle detection system 115.

The controller 306 of the component of the obstacle detection system 115 is further configured to close or terminate the obstacle detector alignment mode. In one approach, the controller 306 closes the obstacle detector alignment mode after a defined period of time, preferably in the range of one second to three hundred seconds. For example, the controller 306 may close the obstacle detector alignment mode after sixty seconds.

In another approach, the controller 306 closes the obstacle detector alignment mode after the first annunciation mode has been effected for a defined period of time, preferably in the range of one second to sixty seconds. For example, the controller may close the obstacle detector alignment mode after the first annunciation mode has been effected for five seconds.

In another approach, the controller 306 is configured to close or terminate the obstacle detector alignment mode in response to receiving an input at the interface 301 of the component of the obstacle detection system 115. In one example, the input is a user input received at the user interface 302 of the component of the obstacle detection system 115. In this regard, a user may instruct the component of the obstacle detection system 115 to close the obstacle detector alignment mode by pressing a button at the user interface 302 of the component of the obstacle detection system 115. In another example, the input is received at the receiver 303 from another device, such as from the movable barrier operator 101, from a wireless operator control device (e.g., remote transmitter 112), from a wired operator control device (e.g., wall-mounted unit 113), from another component of the obstacle detection system 115, or from a remote communication device 120 (e.g., a personal computer, a portable computer, a tablet, or a smartphone). The input received from one of these other devices may be the result of a user input at the other device, or may be the result of alignment determination by the other device.

In the event that the obstacle detector alignment mode is closed prior to alignment of the components, the annunciation system 307 may be configured to cease effecting the second annunciation mode.

The component of the obstacle detection system 115 may further include a memory 308. The memory 308 may store information pertaining to the obstacle detection system 115 including, for example, operational instructions and obstacle status information. The memory 308 may also store information pertaining to various components of the movable barrier system 100 including, for example, a movable barrier operator 101, a remote transmitter 112, a wall control unit 113, or a remote communication device 120 (e.g., a personal computer, a portable computer, a tablet, or a smartphone). Stored information may include component identification information, operational information, and status information.

Figure 4:
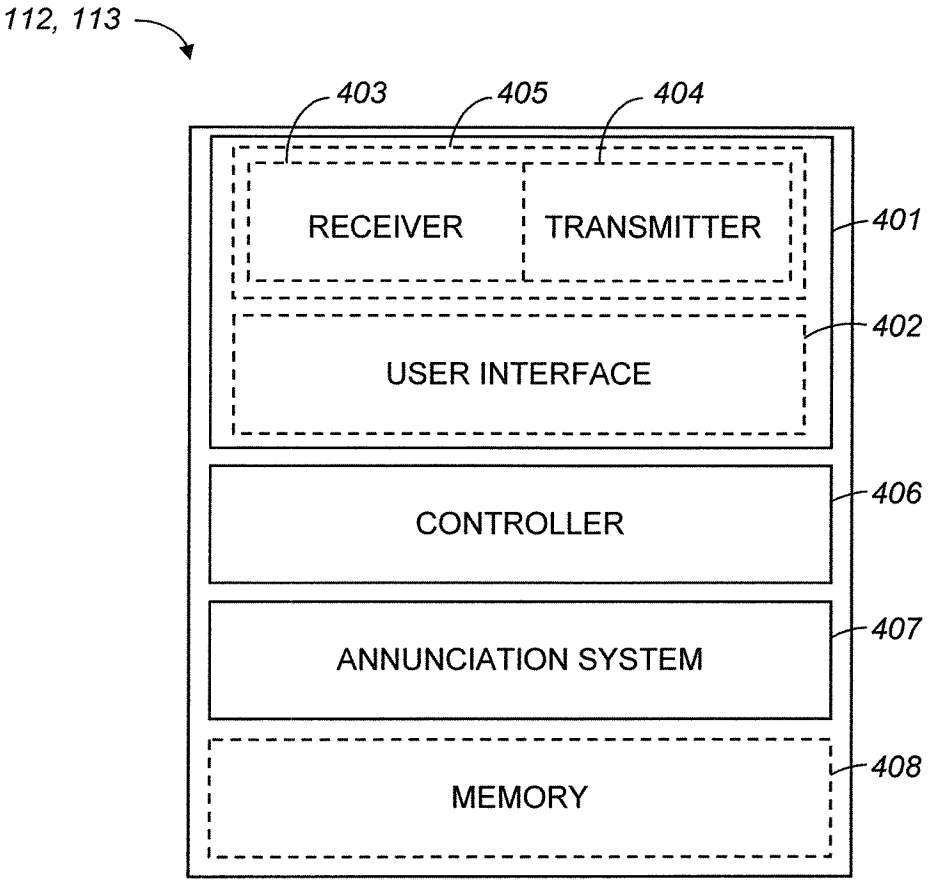
FIG. 4 comprises a schematic block diagram of an operator control device as configured in accordance with an embodiment of the invention.

In a third embodiment, as illustrated in FIG. 4, one or more operator control devices are capable of assisting a user with aligning components of the obstacle detection system 115. The one or more operator control devices may be a wireless remote transmitter 112 or a wired wall-mounted unit 113. These operator control devices permit a user to effect control of a movable barrier operator 101 and, optionally, other components of the movable barrier system (such as a motor or light (not shown)).

In this embodiment, the operator control device 112, 113 includes an interface 401. Through the interface 401, the operator control device 112, 113 can communicate with a user and/or other devices.

The interface 401 is configured to receive an input. In one aspect, the input is received in the form of user input at a user interface 402 of the operator control device 112, 113. The user interface 402 may include, for example, buttons, switches, or a touch screen for receiving an input from a user.

The interface 401 also may include one or more receivers 403 for receiving communications from other devices. For example, the operator control device 112, 113 may receive via the interface 401 transmissions from a movable barrier operator 101. The operator control device 112, 113 may also receive transmissions from other devices, such as components of an obstacle detection system 115 and other remote communication devices 120 capable of communicating with the movable barrier operator. Examples of other remote communication devices 120 include personal computers, portable computers, tablets, and smartphones.

The receiver 403 may also receive transmissions from one or more web servers. Thus, through the receiver 403, the operator control device 112, 113 is capable of receiving communications from any internet-enabled device via a web server.

Communications received by the operator control device 112, 113 may include commands (such as "initiate" or "terminate" an obstacle detector alignment mode), or may include status information (such as "obstacle detection system active," "obstacle detector alignment mode initiated," or "light on").

In an optional approach, the interface 401 is configured to provide an output. In one aspect, the output provides feedback to a user. For example, the user interface 402 may include a liquid crystal display, light emitting diode, or other display to provide information to a user. This information may pertain to the operator control device 112, 113 or to any of the other components of the movable barrier system 100 discussed herein. The user interface 401 may also include a feedback indicator to inform a user of an obstacle detector alignment status.

In another optional approach, the interface 401 may include one or more transmitters 404 for transmitting communications to other devices. Communications transmitted by the operator control device 112, 113 may include commands (such as "turn on" or "enter alignment mode"), or may include status information (such as "obstacle detector system aligned"). The transmitter 404 may be a separate component from the receiver 403, or may be integrated as a single transceiver 405 such that communications with other devices are transmitted by and received at the transceiver 405.

Communications between the operator control device 112, 113 and other devices may be wired or wireless and may be communicated via any of the methods and means discussed herein.

The operator control device 112, 113 includes a controller 406 configured to open or initiate an obstacle detector alignment mode. The obstacle detector alignment mode is a temporal operating state of the operator control device 112, 113. Initiation of the obstacle detector alignment changes the operating state of the operator control device 112, 113 from one state to another; for example, from "obstacle detector alignment mode OFF" to "obstacle detector alignment mode ON." The temporal nature of the alignment mode also allows the operator control device 112, 113 to provide ephemeral alignment feedback that would be a distraction or annoyance if constant.

In one approach, the controller 406 initiates the obstacle detector alignment mode in response to detecting an obstacle detection system 115. For example, the operator control device 112, 113 may automatically detect an initial installation of one or more components of the obstacle detection system 115. Alternatively, the operator control device 112, 113 may determine one or more components of the obstacle detection system 115 are not aligned. For example, in the event a previously aligned component of the obstacle detection system 115 is knocked out of alignment with respect to another component, the operator control device 112, 113 determines the components of the obstacle detection system 115 are not aligned and initiates the obstacle detector alignment mode. The determination of misalignment may be the result of receiving an affirmative indication of misalignment from the obstacle detection system 115, or may instead be the result of not receiving an alignment indication from the obstacle detection system 115.

In another approach, the controller 406 initiates the obstacle detector alignment mode in response to receiving an input at the interface 401 of the operator control device 112, 113. In one example, the input is a user input received at the user interface 402 of the operator control device 112, 113. In this regard, a user may instruct the operator control device 112, 113 to initiate the obstacle detector alignment mode by pressing a button at the user interface 402 of the operator control device 112, 113. In another example, the input is received at the receiver 403 from another device, such as a movable barrier operator 101, from one or more components of obstacle detection system 115, or from a remote communication device 120 (e.g., a personal computer, a portable computer, a tablet, or a smartphone). The input received from one of these other devices may be the result of a user input at the other device, or may be the result of misalignment determination by the other device.

Based on input received at the interface 401, the operator control device 112, 113 is informed, or itself determines, whether the components of the obstacle detection system 115 are aligned. In a first approach, one or more components of the obstacle detection system 115 send the operator control device 112, 113 information relating to the alignment status of the obstacle detection system 115. Other devices of the movable barrier system 100 may also provide information relating to the alignment status of the obstacle detection system 115 to the operator control device 112, 113. The information relating to the alignment status of the obstacle detection system 115 may include an affirmative indication of alignment or an affirmative indication of misalignment.

In a second approach, the operator control device 112, 113 is informed whether the components of the obstacle detection system 115 are aligned based on the absence of information received at the interface 401. In a first example of this approach, the operator control device 112, 113 is configured to receive an affirmative indication of alignment. Here, the operator control device 112, 113 is informed of misalignment when it does not receive the affirmative indication of alignment. In a second example of this approach, the operator control device 112, 113 is configured to receive an affirmative indication of misalignment. Here, the operator control device 112, 113 is informed of alignment when it does not receive the affirmative indication of misalignment.

As shown in FIG. 4, the operator control device 112, 113 includes an annunciation system 407. The annunciation system 407 may include one or more speakers, lights, or display screens, or any combination thereof, to provide a user visual and/or audible feedback. Preferably, the visual and/or audio feedback is of a volume or intensity sufficient to alert a user located away (such as 15 feet or more) from the operator control device 112, 113. Audible feedback may be preferable in a brightly lit setting in which a light on the operator control device 112, 113 may be difficult to see at a distance. Visual feedback may be preferable in a loud setting in which a sound emitted from a speaker on the operator control device 112, 113 may be difficult to hear at a distance. In some settings, a combination of audio and visual feedback is preferable.

As previously discussed, a user must adjust the position and/or orientation of one or more components of the obstacle detection system 115 until the components are aligned. The annunciation system 407 described herein assists a user with aligning components of an obstacle detection system 115 by providing one form of feedback when the components are aligned, and a second form of feedback when the components are not aligned. In this regard, the annunciation system 407 of the operator control device 112, 113 is configured to effect a first annunciation mode in response to a receiving component of the obstacle detection system 115 receiving a signal transmitted from a transmitting component of the obstacle detection system 115, and a second annunciation mode in response to the receiving component of the obstacle detection system 115 not receiving the signal transmitted from the transmitting component of the obstacle detection system 115.

The various annunciation modes, and combinations thereof, discussed above with respect to the movable barrier operator and the one or more components of the obstacle detection system 115 are similarly utilized by the annunciation system 407 of the operator control device 112, 113.

In an optional approach, the annunciation system 407 of the operator control device 112, 113 is configured to effect a third annunciation mode in response to the receiving component of the obstacle detection system 115 receiving a signal transmitted from the transmitting component of the obstacle detection system that is less than a predetermined threshold. This may occur, for example, when the receiving and transmitting components are only partially aligned, and the receiving component receives a portion of, but less than the full signal transmitted from the transmitting component. In this approach, the annunciation system 407 is configured to emit a signal that is different than the signals emitted (or not emitted) in the first and second annunciation modes. The signal emitted in the third annunciation mode may be of the same type of signal emitted in the first and/or second annunciation modes, but may differ, for example, in volume, intensity, frequency, etc.

An illustrative example of use will now be described. When the operator control device 112, 113 is in the obstacle detector alignment mode, and when the receiving component of the obstacle detection system 115 does not receive a signal transmitted from the transmitting component of the obstacle detection system 115, the annunciation system 407 effects the second annunciation mode (for example, a slow beeping sound). As the user moves one of the components into partial alignment with the other component, the annunciation system 407 optionally effects the third annunciation mode (for example, a faster beeping sound). Once the user moves one of the components into full alignment with the other component, the annunciation system 407 effects the first annunciation mode (for example, a constant sound). In this way, the annunciation system 407 assists the user during alignment of the components of the obstacle detection system 115.

The controller 406 of the operator control device 112, 113 is further configured to close or terminate the obstacle detector alignment mode. In one approach, the controller 406 closes the obstacle detector alignment mode after a defined period of time, preferably in the range of one second to three hundred seconds. For example, the controller 406 may close the obstacle detector alignment mode after sixty seconds.

In another approach, the controller 406 closes the obstacle detector alignment mode after the first annunciation mode has been effected for a defined period of time, preferably in the range of one second to sixty seconds. For example, the controller 406 may close the obstacle detector alignment mode after the first annunciation mode has been effected for five seconds.

In another approach, the controller 406 is configured to close or terminate the obstacle detector alignment mode in response to receiving an input at the interface 401 of the operator control device 112, 113. In one example, the input is a user input received at the user interface 402 of the operator control device 112, 113. In this regard, a user may instruct the operator control device 112, 113 to close the obstacle detector alignment mode by pressing a button at the user interface 402 of the operator control device 112, 113. In another example, the input is received at the receiver 403 from another device, such as from the movable barrier operator 101, from a wireless operator control device (e.g., remote transmitter 112), from a wired operator control device (e.g., wall-mounted unit 113), from one or more components of obstacle detection system 115, or from a remote communication device 120 (e.g., a personal computer, a portable computer, a tablet, or a smartphone). The input received from one of these other devices may be the result of a user input at the other device, or may be the result of alignment determination by the other device.

In the event that the obstacle detector alignment mode is closed prior to alignment of the components, the annunciation system 407 may be configured to cease effecting the second annunciation mode.

The operator control device 112, 113 may further include a memory 408. The memory 408 may store information pertaining to the operator control device 112, 113 including, for example, operational instructions and obstacle status information. The memory 408 may also store information pertaining to various components of the movable barrier system 100 including, for example, a movable barrier operator 101, the obstacle detection system 115, or a remote communication device 120 (e.g., a personal computer, a portable computer, a tablet, or a smartphone). Stored information may include component identification information, operational information, and status information.

Figure 5:
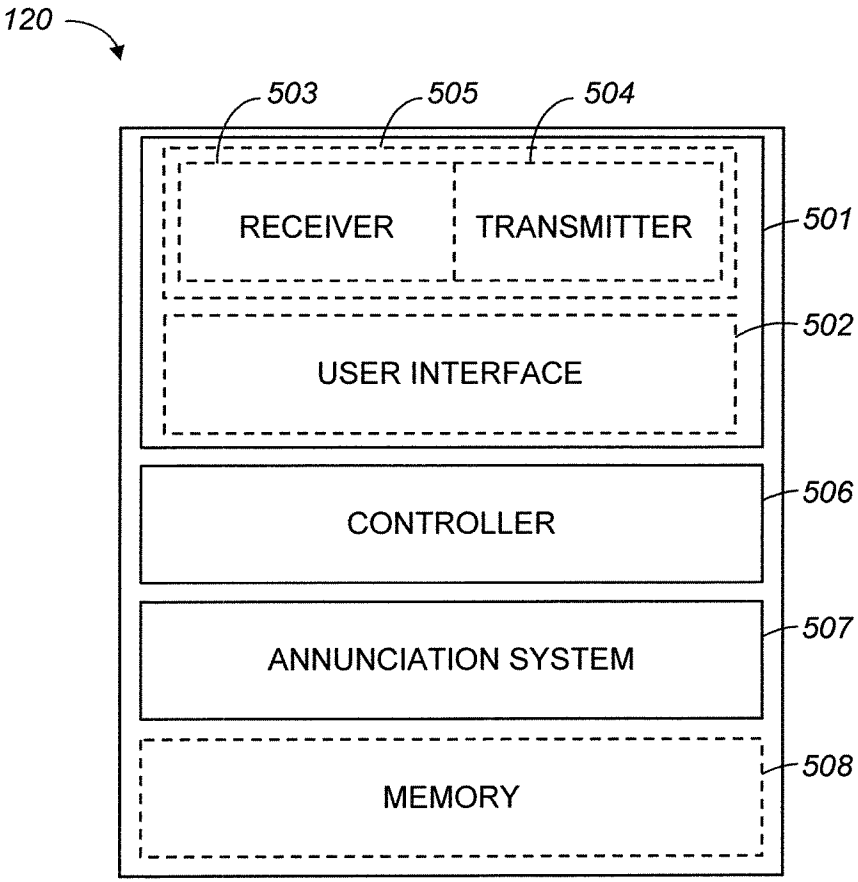
FIG. 5 comprises a schematic block diagram of a remote communication device as configured in accordance with an embodiment of the invention.

In a fourth embodiment, as illustrated in FIG. 5, one or more remote communication devices 120 are capable of assisting a user with aligning components of the obstacle detection system 115. The one or more components may be, for example, a personal computer, a portable computer, a tablet, a smartphone, or other communication device.

In this embodiment, the remote communication device 120 includes an interface 501. Through the interface 501, the remote communication device 120 can communicate with a user and/or other devices.

The interface 501 is configured to receive an input. In one aspect, the input is received in the form of user input at a user interface 502 of the remote communication device 120. The user interface 502 may include, for example, buttons, switches, or a touch screen for receiving an input from a user.

The interface 501 also may include one or more receivers 503 for receiving communications from other devices. For example, the remote communication device 120 may receive via the interface 501 transmissions from a movable barrier operator 101. The remote communication device 120 may also receive transmissions from other devices, such as components of an obstacle detection system 115, from a wireless operator control device, such as a remote transmitter 112, or from a wired operator control device, such as a wall-mounted unit 113.

The receiver 503 may also receive transmissions from one or more web servers. Thus, through the receiver 503, the remote communication device 120 is capable of receiving communications from any internet-enabled device via a web server.

Communications received by the remote communication device 120 may include commands (such as "initiate" or "terminate" an obstacle detector alignment mode), or may include status information (such as "obstacle detection system active," "obstacle detector alignment mode initiated," or "light on").

In an optional approach, the interface 501 is configured to provide an output. In one aspect, the output provides feedback to a user. For example, the user interface 502 may include a liquid crystal display, light emitting diode, or other display to provide information to a user. This information may pertain to the remote communication device 120 or to any of the other components of the movable barrier system 100 discussed herein. The user interface 501 may also include a feedback indicator to inform a user of an obstacle detector alignment status.

In another optional approach, the interface 501 may include one or more transmitters 504 for transmitting communications to other devices. Communications transmitted by the remote communication device 120 may include commands (such as "turn on" or "enter alignment mode"), or may include status information (such as "obstacle detector system aligned"). The transmitter 504 may be a separate component from the receiver 503, or may be integrated as a single transceiver 505 such that communications with other devices are transmitted by and received at the transceiver 505.

Communications between the remote communication device 120 and other devices may be wired or wireless and may be communicated via any of the methods and means discussed herein.

The remote communication device 120 includes a controller 506 configured to open or initiate an obstacle detector alignment mode. The obstacle detector alignment mode is a temporal operating state of the remote communication device 120. Initiation of the obstacle detector alignment changes the operating state of the remote communication device 120 from one state to another; for example, from "obstacle detector alignment mode OFF" to "obstacle detector alignment mode ON." The temporal nature of the alignment mode also allows the remote communication device 120 to provide ephemeral alignment feedback that would be a distraction or annoyance if constant.

In one approach, the controller 506 initiates the obstacle detector alignment mode in response to detecting an obstacle detection system 115. For example, the remote communication device 120 may automatically detect an initial installation of one or more components of the obstacle detection system 115. Alternatively, the remote communication device 120 may determine one or more components of the obstacle detection system 115 are not aligned. For example, in the event a previously aligned component of the obstacle detection system 115 is knocked out of alignment with respect to another component, the remote communication device 120 determines the components of the obstacle detection system 115 are not aligned and initiates the obstacle detector alignment mode. The determination of misalignment may be the result of receiving an affirmative indication of misalignment from the obstacle detection system 115, or may instead be the result of not receiving an alignment indication from the obstacle detection system 115.

In another approach, the controller 506 initiates the obstacle detector alignment mode in response to receiving an input at the interface 501 of the remote communication device 120. In one example, the input is a user input received at the user interface 502 of remote communication device 120. In this regard, a user may instruct the remote communication device 120 to initiate the obstacle detector alignment mode by pressing a button at the user interface 502 of the remote communication device 120. In another example, the input is received at the receiver 503 from another device, such as from the movable barrier operator 101, from a wireless operator control device (e.g., remote transmitter 112), from a wired operator control device (e.g., wall-mounted unit 113), from one or more components of obstacle detection system 115, or from another remote communication device 120 (e.g., a personal computer, a portable computer, a tablet, or a smartphone). The input received from one of these other devices may be the result of a user input at the other device, or may be the result of misalignment determination by the other device.

Based on input received at the interface 501, the remote communication device 120 is informed, or itself determines, whether the components of the obstacle detection system 115 are aligned. In a first approach, one or more components of the obstacle detection system 115 send the remote communication device 120 information relating to the alignment status of the obstacle detection system 115. Other devices of the movable barrier system 100 may also provide information relating to the alignment status of the obstacle detection system 115 to the remote communication device 120. The information relating to the alignment status of the obstacle detection system 115 may include an affirmative indication of alignment or an affirmative indication of misalignment.

In a second approach, the remote communication device 120 is informed whether the components of the obstacle detection system 115 are aligned based on the absence of information received at the interface 501. In a first example of this approach, the remote communication device 120 is configured to receive an affirmative indication of alignment. Here, the remote communication device 120 is informed of misalignment when it does not receive the affirmative indication of alignment. In a second example of this approach, the remote communication device 120 is configured to receive an affirmative indication of misalignment. Here, the remote communication device 120 is informed of alignment when it does not receive the affirmative indication of misalignment.

As shown in FIG. 5, the remote communication device 120 includes an annunciation system 507. The annunciation system 507 may include one or more speakers, lights, or display screens, or any combination thereof, to provide a user visual and/or audible feedback. Preferably, the visual and/or audio feedback is of a volume or intensity sufficient to alert a user located away (such as 15 feet or more) from the remote communication device 120. Audible feedback may be preferable in a brightly lit setting in which a light on the remote communication device 120 may be difficult to see at a distance. Visual feedback may be preferable in a loud setting in which a sound emitted from a speaker on the remote communication device 120 may be difficult to hear at a distance. In some settings, a combination of audio and visual feedback is preferable.

As previously discussed, a user must adjust the position and/or orientation of one or more components of the obstacle detection system 115 until the components are aligned. The annunciation system 507 described herein assists a user with aligning components of an obstacle detection system 115 by providing one form of feedback when the components are aligned, and a second form of feedback when the components are not aligned. In this regard, the annunciation system 507 of the remote communication device 120 is configured to effect a first annunciation mode in response to a receiving component of the obstacle detection system 115 receiving a signal transmitted from a transmitting component of the obstacle detection system 115, and a second annunciation mode in response to the receiving component of the obstacle detection system 115 not receiving the signal transmitted from the transmitting component of the obstacle detection system 115.

The various annunciation modes, and combinations thereof, discussed above with respect to the movable barrier operator and the one or more components of the obstacle detection system 115 are similarly utilized by the annunciation system 507 of the remote communication device 120.

In an optional approach, the annunciation system 507 of the remote communication device 120 is configured to effect a third annunciation mode in response to the receiving component of the obstacle detection system 115 receiving a signal transmitted from the transmitting component of the obstacle detection system that is less than a predetermined threshold. This may occur, for example, when the receiving and transmitting components are only partially aligned, and the receiving component receives a portion of, but less than the full signal transmitted from the transmitting component. In this approach, the annunciation system 507 is configured to emit a signal that is different than the signals emitted (or not emitted) in the first and second annunciation modes. The signal emitted in the third annunciation mode may be of the same type of signal emitted in the first and/or second annunciation modes, but may differ, for example, in volume, intensity, frequency, etc.

An illustrative example of use will now be described. When the remote communication device 120 is in the obstacle detector alignment mode, and when the receiving component of the obstacle detection system 115 does not receive a signal transmitted from the transmitting component of the obstacle detection system 115, the annunciation system 507 effects the second annunciation mode (for example, a slow beeping sound). As the user moves one of the components into partial alignment with the other component, the annunciation system 507 optionally effects the third annunciation mode (for example, a faster beeping sound). Once the user moves one of the components into full alignment with the other component, the annunciation system 507 effects the first annunciation mode (for example, a constant sound). In this way, the annunciation system 507 assists the user during alignment of the components of the obstacle detection system 115.

The controller 506 of the remote communication device 120 is further configured to close or terminate the obstacle detector alignment mode. In one approach, the controller 506 closes the obstacle detector alignment mode after a defined period of time, preferably in the range of one second to three hundred seconds. For example, the controller 506 may close the obstacle detector alignment mode after sixty seconds.

In another approach, the controller 506 closes the obstacle detector alignment mode after the first annunciation mode has been effected for a defined period of time, preferably in the range of one second to sixty seconds. For example, the controller 506 may close the obstacle detector alignment mode after the first annunciation mode has been effected for five seconds.

In another approach, the controller 506 is configured to close or terminate the obstacle detector alignment mode in response to receiving an input. In one example, the input is a user input received at the user interface 502 of the remote communication device 120. In another example, the user input is received at a movable barrier operator 101, and transmitted to the remote communication device 120. In this regard, a user may instruct the remote communication device 120 to close the obstacle detector alignment mode by pressing a button at the user interface 502 of the remote communication device 120. In another example, the input is received at the receiver 203 from another device, such as from the movable barrier operator 101, from a wireless operator control device (e.g., remote transmitter 112), from a wired operator control device (e.g., wall-mounted unit 113), from one or more components of obstacle detection system 115, or from another remote communication device 120 (e.g., a personal computer, a portable computer, a tablet, or a smartphone). The input received from one of these other devices may be the result of a user input at the other device, or may be the result of alignment determination by the other device.

In the event that the obstacle detector alignment mode is closed prior to alignment of the components, the annunciation system 507 may be configured to cease effecting the second annunciation mode.

The remote communication device 120 may further include a memory 508. The memory 508 may store information pertaining to the remote communication device 120 including, for example, operational instructions and obstacle status information. The memory 508 may also store information pertaining to various components of the movable barrier system 100 including, for example, a movable barrier operator 101, a remote transmitter 112, a wall control unit 113, or the obstacle detection system 115. Stored information may include component identification information, operational information, and status information.

In a fifth embodiment, various components of the movable barrier system 100 may be configured to work together to assist a user with aligning components of the obstacle detection system 115. These various components may include a movable barrier operator 101, a wireless operator control device (e.g., remote transmitter 112), a wired operator control device (e.g., wall-mounted unit 113), one or more components of obstacle detection system 115, or a remote communication device 120 (e.g., a personal computer, a portable computer, a tablet, or a smartphone). In the below examples, either or both devices may be configured to initiate and terminate the obstacle detector alignment mode according to the teachings above.

In one example, the annunciation systems of the movable barrier operator 101 and a component of the obstacle detection system 115 are both used during alignment of the components of the obstacle detection system 115. In this example, when the receiving component of the obstacle detection system 115 does not receive a signal transmitted from the transmitting component of the obstacle detection system 115, the annunciation system 307 of the obstacle detection system 115 effects the second annunciation mode (for example, a slow beeping sound). As the user moves one of the components into partial alignment with the other component, the annunciation system 207 of the movable barrier operator 101 optionally effects the third annunciation mode (for example, a faster beeping sound or a blinking light). Once the user moves one of the components into full alignment with the other component, the annunciation system 207 of the movable barrier operator 101 effects the first annunciation mode (for example, a constant sound or light). In this way, the annunciation systems 207, 307 work together to assist the user during alignment of the components of the obstacle detection system 115.

In another example, the annunciation system 207 of the movable barrier operator 101 in the above scenario is replaced with another component of the obstacle detection system 115. In yet another example, the annunciation system 407 of an operator control device (e.g., wall-mounted unit 113) works in conjunction with the annunciation system 507 of a remote communication device 120. Using the various devices and components described herein, a wide variety of modifications, alterations, and combinations can be achieved to assist a user during alignment of the components of the obstacle detection system 115.

The annunciation systems described herein may be suitable for various purposes not relating to the alignment of components of an obstacle detection system. Such uses may include low battery notifications, reversal notification, obstruction notification, pre-motion notification, and timer active notification.

Figure 6:
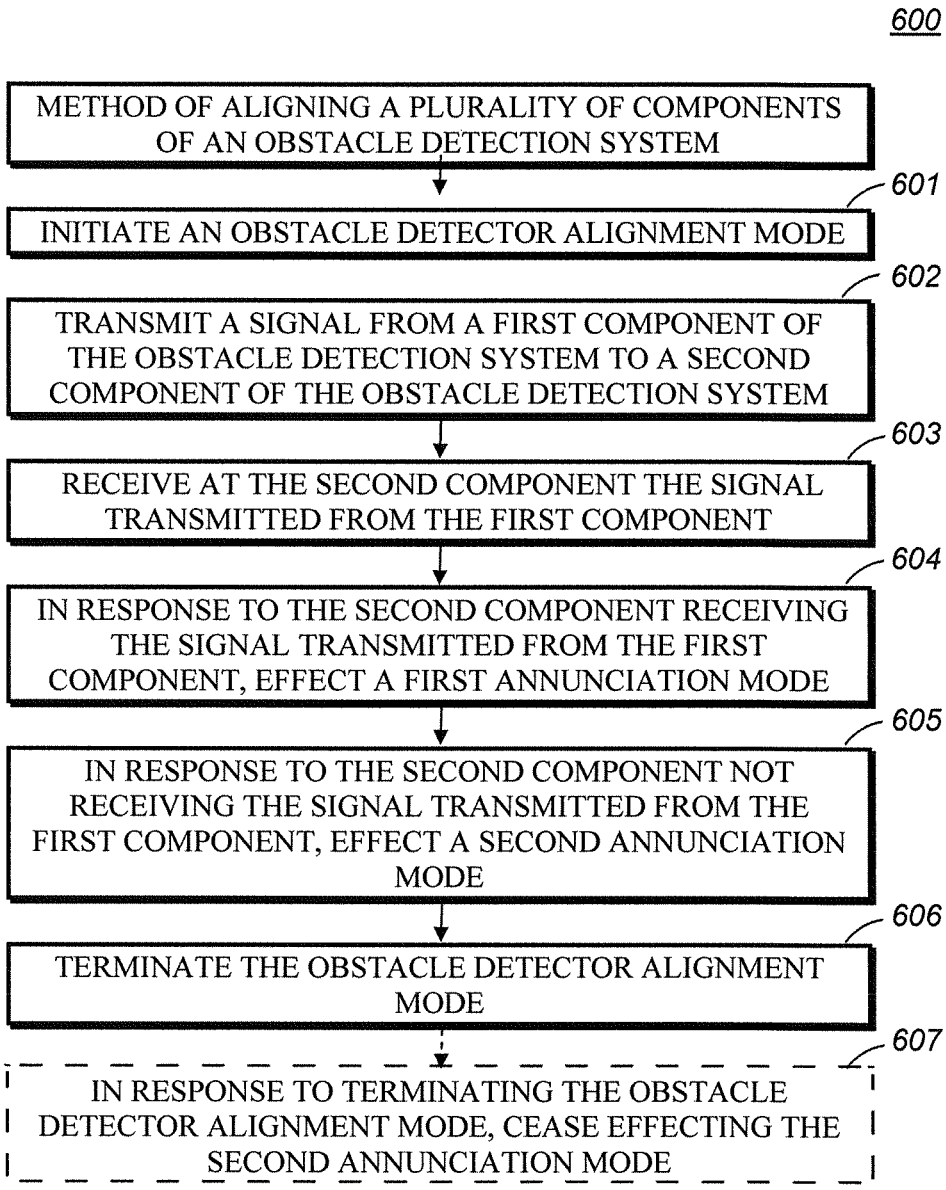
FIG. 6 comprises a flow diagram illustrating a method of aligning a plurality of components of an obstacle detection system as configured in accordance with various embodiments of the invention.

Turning now to FIG. 6, a method 600 of aligning a plurality of components of an obstacle detection system 115 includes opening or initiating 601 an obstacle detector alignment mode. In one approach, the obstacle detector alignment mode is initiated in response to detecting an obstacle detection system 115. For example, the obstacle detector alignment mode may be initiated in response to detecting an initial installation of one or more components of the obstacle detection system 115. Alternatively, the obstacle detector alignment mode is initiated in response to determining one or more components of the obstacle detection system 115 are not aligned. This determination of misalignment may be the result of receiving an affirmative indication of misalignment, or may instead be the result of not receiving an alignment indication.

In another approach, the obstacle detector alignment mode is initiated in response to receiving an input, for example, at an interface. In one example, the input is a user input received at the user interface. In another example, the input is received at a receiver.

The method 600 further includes transmitting 602 a signal from a first component of the obstacle detection system to a second component of the obstacle detection system 115. The method also includes transmitting 603 a signal from a first component of the obstacle detection system to a second component of the obstacle detection system 115.

The method further includes, in response to the second component receiving the signal transmitted from the first component, effecting 604 a first annunciation mode. The method also includes, in response to the second component not receiving the signal transmitted from the first component, effecting 605 a second annunciation mode.

In one approach, effecting 604 the first annunciation mode comprises emitting a first audible signal, and effecting 605 the second annunciation mode comprises emitting a second audible signal. In another approach, effecting 604 the first annunciation mode comprises emitting an audible signal, and effecting 605 the second annunciation mode comprises emitting no audible signal. In yet another approach, effecting 604 the first annunciation mode comprises emitting no audible signal, and effecting 605 the second annunciation mode comprises emitting an audible signal. In yet another approach, effecting 604 the first annunciation mode comprises emitting a first optical signal, and effecting 605 the second annunciation mode comprises emitting a second optical signal. In yet another approach, effecting 604 the first annunciation mode comprises emitting an optical signal, and effecting 605 the second annunciation mode comprises emitting no optical signal. In yet another approach, effecting 604 the first annunciation mode comprises emitting no optical signal, and 605 effecting the second annunciation mode comprises emitting an optical signal. The feedback provided in the first and second annunciation modes is not intended to be limited to the above-described examples. Various combinations audio and visual feedback are envisioned, as discussed above.

In an optional approach, the method further includes, in response to the second component receiving a portion of, but less than the full signal transmitted from the first component, effecting a third annunciation mode. This may occur, for example, when the first and second components are only partially aligned, and the second component receives a portion of, but less than the full signal transmitted from the first component. In this approach, effecting the third annunciation mode comprises emitting a signal that is different than the signals emitted (or not emitted) in the first and second annunciation modes. The signal emitted in the third annunciation mode may be of the same type of signal emitted in the first and/or second annunciation modes, but may differ, for example, in volume, intensity, frequency, or the like.

According to one approach, at least one of the first annunciation mode and the second annunciation mode is effected at the first component of the obstacle detection system, the second component of the obstacle detection system, and/or a third component of the obstacle detection system. An example of a third component of the obstacle detection is an obstacle detection system control unit 118, discussed above. The obstacle detection control unit 118 may be hard wired to one or both of the first and second components of the obstacle detection system 115, or may be in wireless communication with one or both of the first and second components.

According to another approach, at least one of the first annunciation mode and the second annunciation mode is effected at a barrier operator. According to another approach, at least one of the first annunciation mode and the second annunciation mode is effected at an operator control device. An example of an operator control device may be a wireless operator control device (such as the remote transmitter 112 discussed above) or a wired operator control device (such as the wall-mounted unit 113 discussed above). These operator control devices permit a user to effect control of a movable barrier operator 101 and, optionally, other components of the movable barrier system. According to another approach, at least one of the first annunciation mode and the second annunciation mode is effected at a remote communication device. Examples of remote communication devices include personal computers, portable computers, tablets, and smartphones.

The method further includes closing or terminating 606 the obstacle detector alignment mode. In one approach, the obstacle detector alignment mode is terminated after a defined period of time, preferably in the range of one second to three hundred seconds. For example, the obstacle detector alignment mode may be terminated after sixty seconds.

In another approach, the obstacle detector alignment mode is terminated after the first annunciation mode has been effected for a defined period of time, preferably in the range of one second to sixty seconds. For example, the obstacle detector alignment mode may be terminated after the first annunciation mode has been effected for five seconds.

In another approach, the obstacle detector alignment mode is terminated in response to receiving an input, for example, at an interface. In one example, the input is a user input received at the user interface. In another example, the input is received at a receiver.

In the event that the obstacle detector alignment mode is terminated prior to alignment of the components, the method optionally further comprises ceasing effecting 607 the second annunciation mode.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention.

What is claimed is:

1. An apparatus comprising:

an interface configured to receive an input;

a controller in communication with the interface, the controller configured to initiate an obstacle detector alignment mode in response to received input, the controller further configured to terminate the obstacle detector alignment mode; and an annunciation system configured to, during the obstacle detector alignment mode, effect a first annunciation mode in response to a receiving component of an obstacle detection system receiving a signal transmitted from a transmitting component of the obstacle detection system, the annunciation system further configured to, during the obstacle detector alignment mode, effect a second annunciation mode in response to the receiving component of the obstacle detection system not receiving the signal transmitted from the transmitting component of the obstacle detection system.

2. The apparatus of claim 1, wherein the annunciation system is further configured to effect a third annunciation mode in response to the receiving component of the obstacle detection system receiving only a portion of the signal transmitted from the transmitting component of the obstacle detection system.

3. The apparatus of claim 1, wherein the apparatus is a barrier operator.

4. The apparatus of claim 1, wherein the apparatus is a component of the obstacle detection system selected from the group consisting of the receiving component of the obstacle detection system, the transmitting component of the obstacle detection system, and a third component of the obstacle detection system.

5. The apparatus of claim 1, wherein the apparatus is an operator control device selected from the group consisting of a remote transmitter and a wall control unit.

6. The apparatus of claim 1, wherein the apparatus is a remote communication device selected from the group consisting of: a personal computer, a portable computer, a tablet, and a smartphone.

7. The apparatus of claim 1, wherein the controller is configured to initiate the obstacle detector alignment mode in response to detecting the obstacle detection system.

8. The apparatus of claim 1, wherein the controller is configured to initiate the obstacle detector alignment mode in response to determining misalignment of a component of the obstacle detection system selected from the group consisting of: the receiving component of the obstacle detection system, the transmitting component of the obstacle detection system, and a third component of the obstacle detection system.

9. The apparatus of claim 1, wherein the controller is configured to initiate the obstacle detector alignment mode in response to receiving an initiation input at the interface.

10. The apparatus of claim 9, wherein the input is a user input received at a user interface of the interface.

11. The apparatus of claim 9, wherein the input is received from another device at a receiver of the interface.

12. The apparatus of claim 1, wherein the annunciation system is configured to emit a first audible signal in the first annunciation mode, and wherein the annunciation system is configured to emit a second audible signal in the second annunciation mode.

13. The apparatus of claim 1, wherein the annunciation system is configured to emit an audible signal in the first annunciation mode, and wherein the annunciation system is configured to emit no audible signal in the second annunciation mode.

14. The apparatus of claim 1, wherein the annunciation system is configured to emit no audible signal in the first annunciation mode, and wherein the annunciation system is configured to emit an audible signal in the second annunciation mode.

15. The apparatus of claim 1, wherein the annunciation system is configured to emit a first optical signal in the first annunciation mode, and wherein the annunciation system is configured to emit a second optical signal in the second annunciation mode.

16. The apparatus of claim 1, wherein the annunciation system is configured to emit an optical signal in the first annunciation mode, and wherein the annunciation system is configured to emit no optical signal in the second annunciation mode.

17. The apparatus of claim 1, wherein the annunciation system is configured to emit no optical signal in the first annunciation mode, and wherein the annunciation system is configured to emit an optical signal in the second annunciation mode.

18. The apparatus of claim 1, wherein at least one of the first annunciation mode and the second annunciation mode is effected at a component of the obstacle detection system selected from the group consisting of: the first component, the second component, and a third component.

19. The apparatus of claim 1, wherein at least one of the first annunciation mode and the second annunciation mode is effected at a barrier operator.

20. The apparatus of claim 1, wherein at least one of the first annunciation mode and the second annunciation mode is effected at an operator control device selected from the group consisting of a remote transmitter and a wall control unit.

21. The apparatus of claim 1, wherein at least one of the first annunciation mode and the second annunciation mode is effected at a remote communication device selected from the group consisting of: a personal computer, a portable computer, a tablet, and a smartphone.

22. The apparatus of claim 1, wherein the controller is configured to terminate the obstacle detector alignment mode after the first annunciation mode has been effected for a period of time in a range of one second to sixty seconds.

23. The apparatus of claim 1, wherein the controller is configured to terminate the obstacle detector alignment mode in response to receiving a termination input at the interface.

24. The apparatus of claim 23, wherein the input is a user input received at a user interface of the interface.

25. The apparatus of claim 23, wherein the input is received from another device at a receiver of the interface.

26. The apparatus of claim 1, wherein the annunciation system is configured to cease effecting the second annunciation mode in response to the controller terminating the obstacle detector alignment mode.

27. A method of aligning a plurality of components of an obstacle detection system, the method comprising:

initiating an obstacle detector alignment mode;

transmitting a signal from a first component of the obstacle detection system to a second component of the obstacle detection system during the obstacle detector alignment mode:

determining whether the second component is receiving the signal transmitted from the first component;

in response to determining the second component is receiving the signal transmitted from the first component, effecting a first annunciation mode;

in response to determining the second component is not receiving the signal transmitted from the first component, effecting a second annunciation mode; and terminating the obstacle detector alignment mode.

28. The method of claim 27, further comprising:

in response to the second component receiving only a portion of the signal transmitted from the first component, effecting a third annunciation mode.

29. The method of claim 27, wherein initiating the obstacle detector alignment mode is effected in response to detecting the obstacle detection system.

30. The method of claim 27, wherein initiating the obstacle detector alignment mode is effected in response to determining misalignment of a component of the obstacle detection system selected from the group consisting of: the first component, the second component, and a third component.

31. The method of claim 27, wherein initiating the obstacle detector alignment mode is effected in response to receiving an input at an interface.

32. The method of claim 27, wherein the effecting the first annunciation mode or the effecting the second annunciation mode comprise emitting effecting different ones of the group comprising: a first audible signal, a second audible signal different from the first audible signal, emission of no audible signal, a first optical signal, a second optical signal different from the first optical signal, emission of no optical signal, and combinations thereof.

33. The method of claim 27, wherein at least one of the first annunciation mode and the second annunciation mode is effected at a component of the obstacle detection system selected from the group consisting of: the first component, the second component, and a third component.

34. The method of claim 27, wherein at least one of the first annunciation mode and the second annunciation mode is effected at a barrier operator.

35. The method of claim 27, wherein at least one of the first annunciation mode and the second annunciation mode is effected at an operator control device selected from the group consisting of a remote transmitter and a wall control unit.

36. The method of claim 27, wherein at least one of the first annunciation mode and the second annunciation mode is effected at a remote communication device selected from the group consisting of: a personal computer, a portable computer, a tablet, and a smartphone.

37. The method of claim 27, wherein terminating the obstacle detector alignment mode is effected automatically after the first annunciation mode has been effected for a period of time in a range of one second to sixty seconds.

38. The method of claim 27, wherein terminating the obstacle detector alignment mode is effected in response to receiving an input at an interface.

39. The method of claim 27, further comprising:

in response to terminating the obstacle detector alignment mode, ceasing effecting the second annunciation mode.

40. An apparatus for facilitating alignment of an obstacle detection system, the apparatus comprising:

an obstacle detection system comprising a transmitting component configured to transmit a signal and a receiving component configured to receive the signal; and a movable barrier operator system comprising:

an interface configured to receive an input;

a controller in communication with the interface, the controller configured to initiate an obstacle detector alignment mode in response to received input, the controller further configured to terminate the obstacle detector alignment mode;

an annunciation system configured to, during the obstacle detector alignment mode, effect a first annunciation mode in response to a receiving component of an obstacle detection system receiving a signal transmitted from a transmitting component of the obstacle detection system, the annunciation system further configured to, during the obstacle detector alignment mode, effect a second annunciation mode in response to the receiving component of the obstacle detection system not receiving the signal transmitted from the transmitting component of the obstacle detection system.

* * * * *